US006702893B2

(12) United States Patent
Thome et al.

(10) Patent No.: US 6,702,893 B2
(45) Date of Patent: Mar. 9, 2004

(54) PROCESS AND STATION FOR CHANGING PRODUCT IN AN INSTALLATION FOR SPRAYING COATING PRODUCT

(75) Inventors: Caryl Thome, Saint Egreve (FR); Philippe Provenaz, Grenoble (FR); Louis Sentis, Grenoble (FR)

(73) Assignee: Sames Technologies, Meylan (FR)

( * ) Notice: Subject to any disclaimer, the term of this patent is extended or adjusted under 35 U.S.C. 154(b) by 18 days.

(21) Appl. No.: 10/117,104

(22) Filed: Apr. 8, 2002

(65) Prior Publication Data

US 2002/0124799 A1 Sep. 12, 2002

Related U.S. Application Data

(62) Division of application No. 09/642,825, filed on Aug. 22, 2000, now Pat. No. 6,391,392.

(30) Foreign Application Priority Data

Aug. 30, 1999 (FR) ..... 99 10992

(51) Int. Cl.[7] ..... B05B 15/02; B05B 3/00

(52) U.S. Cl. ..... 118/302; 118/323; 901/43; 239/112

(58) Field of Search ..... 118/302, 203, 118/323, 310; 239/112, 106, 108, 110, 119, 305; 222/148; 901/43

(56) References Cited

U.S. PATENT DOCUMENTS

| | | | | |
|---|---|---|---|---|
| 4,785,760 | A | 11/1988 | Tholome | |
| 4,792,092 | A | 12/1988 | Elberson et al. | |
| 4,830,882 | A | 5/1989 | Ichinose et al. | |
| 4,944,459 | A | 7/1990 | Watanabe et al. | |
| 5,772,125 | A | 6/1998 | Ehinger et al. | |
| 6,458,424 | B1 * | 10/2002 | Yoshida et al. | 118/302 |

FOREIGN PATENT DOCUMENTS

| | | |
|---|---|---|
| EP | 0 034 687 | 9/1981 |
| EP | 0 274 322 | 7/1988 |

* cited by examiner

*Primary Examiner*—Richard Crispino
*Assistant Examiner*—Yewebdar T Tadesse
(74) *Attorney, Agent, or Firm*—Browdy and Neimark, P.L.L.C.

(57) ABSTRACT

A process and station for changing product in an installation for spraying coating product, by bringing a first reservoir towards a suitable area of a cleaning/filling station, separating a sub-assembly composed of the first reservoir and a first spray associated therewith, with respect to the robot, connecting with the robot a second, similar sub-assembly composed of a second reservoir and a second spray, adapted to be used for spraying coating product during cleaning and/or filling of the first reservoir and the first spray, and proceeding with cleaning and/or filling of the first reservoir and the first spray in the area.

6 Claims, 10 Drawing Sheets

PROCESS AND STATION FOR CHANGING PRODUCT IN AN INSTALLATION FOR SPRAYING COATING PRODUCT

This is a division of parent application Ser. No. 09/642,825, filed Aug. 22, 2000, now U.S. Pat. No. 6,391,392.

The present invention relates to a process and station for changing product in an installation for spraying coating product.

It is known, for example from EP-A-0 274 322, to use a reservoir, mounted at the end of an arm of a multi-axis robot, for supplying coating product to a spray supported by this arm, in particular in the case of an installation for spraying an electrically conducting coating product by means of a spray of an electrostatic type. This state of the art provides using a fixed spray on the arm of the robot and cleaning it and filling it with new coating product as a function of needs. According to a variant, the reservoir is removably mounted on the spray and a plurality of reservoirs are used as a function of the coating product chosen. Finally, according to a second variant, two reservoirs are used alternately.

In all cases, it is necessary to clean the spray, which is permanently mounted on the robot arm, and to prime it with new coating product. These rinsing and priming operations are relatively long while the time allocated to changing coating product tends to decrease. In effect, in the case of an automobile production line, the tendency is to increase production rates and therefore the speeds of advance of the conveyor belts, the change of coating product being effected in a time corresponding to the space separating two consecutive vehicle bodies, the available time being all the shorter as the speed of conveyance increases.

It is an object of the present invention to solve these problems by proposing a novel process and a novel station for changing coating product, which allow a rapid change while the quality of the cleaning effected remains optimum.

The above and other objects are achieved, according to the present invention, by a process for changing product in an installation for spraying coating product, comprising at least one robot, adapted to move a first sprayer and a first reservoir associated therewith opposite objects to be coated, this process comprising a step of bringing this reservoir towards a suitable area of a cleaning/filling station, characterized in that it consists in:

separating a sub-assembly, comprising the first reservoir and the first sprayer, with respect to the robot;

connecting with this robot a second, similar sub-assembly comprising a second reservoir and a second sprayer, this second sub-assembly being adapted to be used for spraying coating product during cleaning and/or filling of the first reservoir and the first sprayer, and proceeding with cleaning and/or filling of the first reservoir and the first sprayer in said area.

Thanks to the invention, the first reservoir can be cleaned and filled with new coating product in masked time. The spray is also cleaned and primed with the new coating product in masked time, with the result that the only steps of the cleaning/filling process which must be taken into account in the calculation of the time taken to change the product, are the steps of separation of the first sub-assembly from and of connection of the second sub-assembly on the arm of the robot. In other words, the time which was consumed up to the present time for cleaning the spray and priming it with new coating product is now available for spraying by means of the second sub-assembly, since these operations take place on the first sub-assembly in masked time while the second sub-assembly is being used.

According to a first advantageous aspect of the invention, the process consists in supplying the first sub-assembly with air, cleaning product and/or coating product in the suitable area of the cleaning/filling stations, before it is separated from the robot. In this way, certain functions of the spray and/or of the reservoir may be maintained, including during separation between this sub-assembly and the robot.

According to another advantageous aspect of the invention, the sub-assembly is supplied with air, electric current, cleaning product and/or coating product by means of two mobile units, a first unit being connected to the sub-assembly before its separation from the robot, while a second unit is connected to the sub-assembly after its separation from the robot, in place of the connection part of the robot.

In particular, the spray, or sprayer, may be supplied with air continuously to form a bearing between parts of the spray, or sprayer, that are in relative movement. This proves particularly advantageous in the case of a rotary sprayer, as the continuous supply of air to the bearing avoids any risk of this bearing locking or seizing.

The invention also relates to a product changing station in an installation for spraying coating product, which carries out the process as described hereinbefore. This station, which comprises at least two reservoir cleaning/filling areas, is characterized in that these areas are adapted each to receive a sub-assembly formed by a reservoir and a spray while this sub-assembly is disconnected from the robot, means being provided for cleaning and/or filling the reservoir and the spray in each of these areas.

In this way, each sub-assembly may be cleaned and/or filled in masked time while a similar sub-assembly is being used on the robot.

According to a first advantageous aspect of the invention, the reservoir and spray cleaning/filling means comprise two mobile units adapted to be coupled independently in two areas of connection of the sub-assembly, a first unit being adapted to be connected to the sub-assembly mounted on the robot while the second unit is adapted to be connected to the sub-assembly in place of the connection part of the robot. The first unit advantageously comprises means for connection between a source of compressed air and a bearing formed in the spray, between two parts in relative movement. In this way, the bearing may be permanently supplied, which avoids the risks of this bearing locking or seizing.

In particular, the second unit may comprise a jack whose rod is adapted to manoeuvre a piston of the reservoir, in particular for bleeding this reservoir.

According to another advantageous aspect, the station comprises means for locking a sub-assembly in each of the cleaning/filling areas, by rotation of a ring surrounding this sub-assembly, and adapted to cooperate with projections on this sub-assembly in order to rotate it with respect to the robot. Displacement of this ring between a position of locking and a position of unlocking of the sub-assembly, is advantageously controlled by a jack.

The invention will be more readily understood on reading the following description of an embodiment of a product changing station according to the invention and of the process for employing it, given solely by way of example and made with reference to the accompanying drawings, in which:

Figure 1:
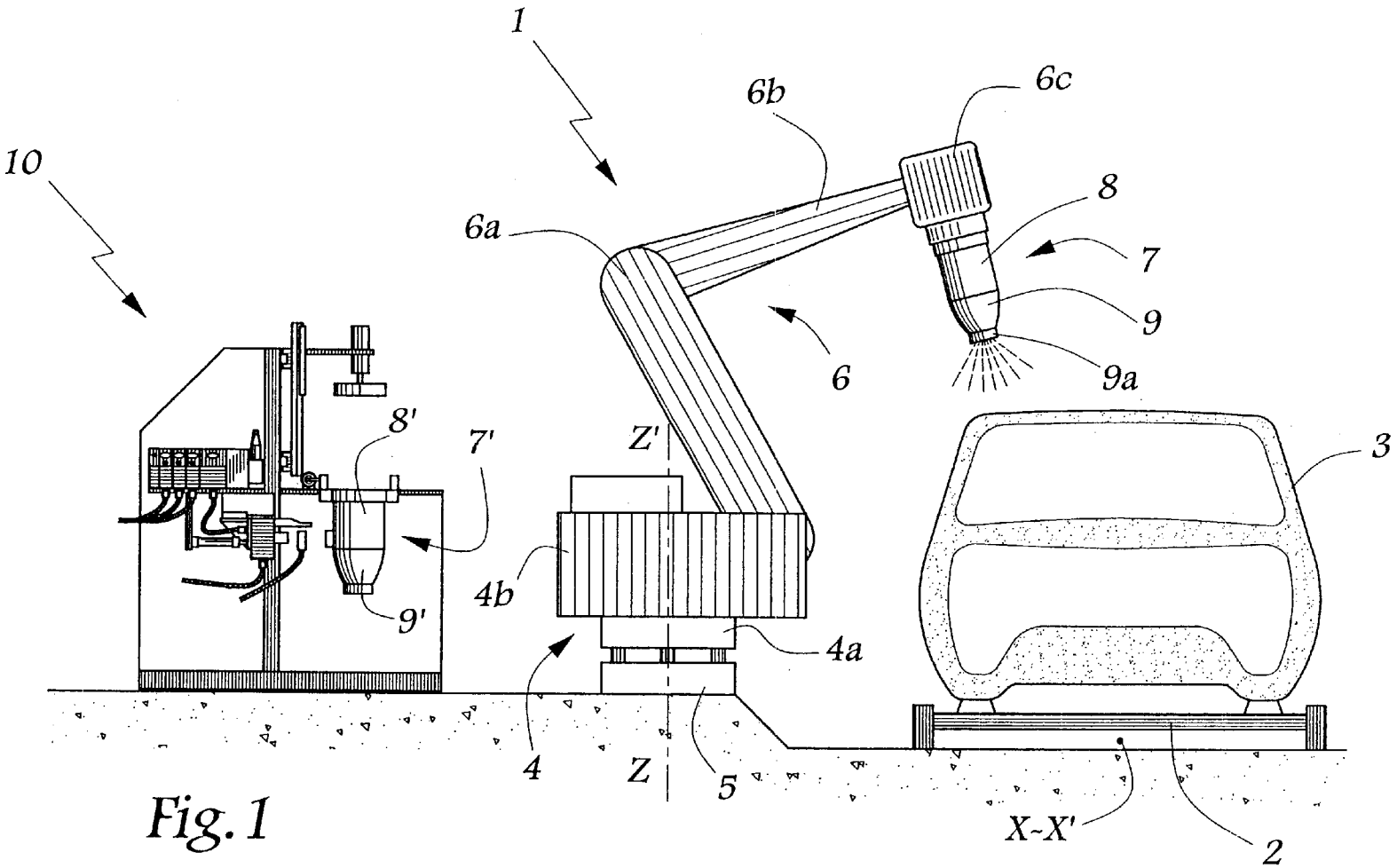
FIG. 1 schematically shows the principle of an installation for spraying coating product during operation.

Referring now to the drawings, and firstly to FIG. 1, an automat or robot 1 is arranged near a conveyor 2 transporting objects to be coated, in the present case automobile vehicle bodies 3. The robot 1 is of the multi-axis type and comprises a chassis 4 mobile on a guide 5 extending parallel to the direction of conveyance X–X'. An arm 6 is supported by the chassis 4 and comprises a plurality of segments 6*a*, 6*b* and 6*c* articulated with respect to one another. The chassis 4 is likewise constituted by parts 4*a* and 4*b* articulated with respect to each other about a substantially vertical axis Z.

Segment 6*c* of arm 6 supports a sub-assembly 7 in which are provided a reservoir 8 of coating product and a spray 9. Spray 9 is of the electrostatic and rotary type and it bears a bowl 9*a* intended to be driven at high speed by an air turbine provided in the spray 9.

When an automobile vehicle body 3 is in position at the level of robot 1, the sub-assembly 7 is disposed opposite the body and the spray 9 is activated in order to coat this body with the product contained in the reservoir 8. The quantity of product present in the reservoir 8 is adapted to the surface of the body 3 to be coated.

When a body has been coated, and while a second body is advancing towards the robot 1, the latter is oriented towards a cleaning/filling station 10 located in its vicinity, inside the spray booth.

Figure 2:
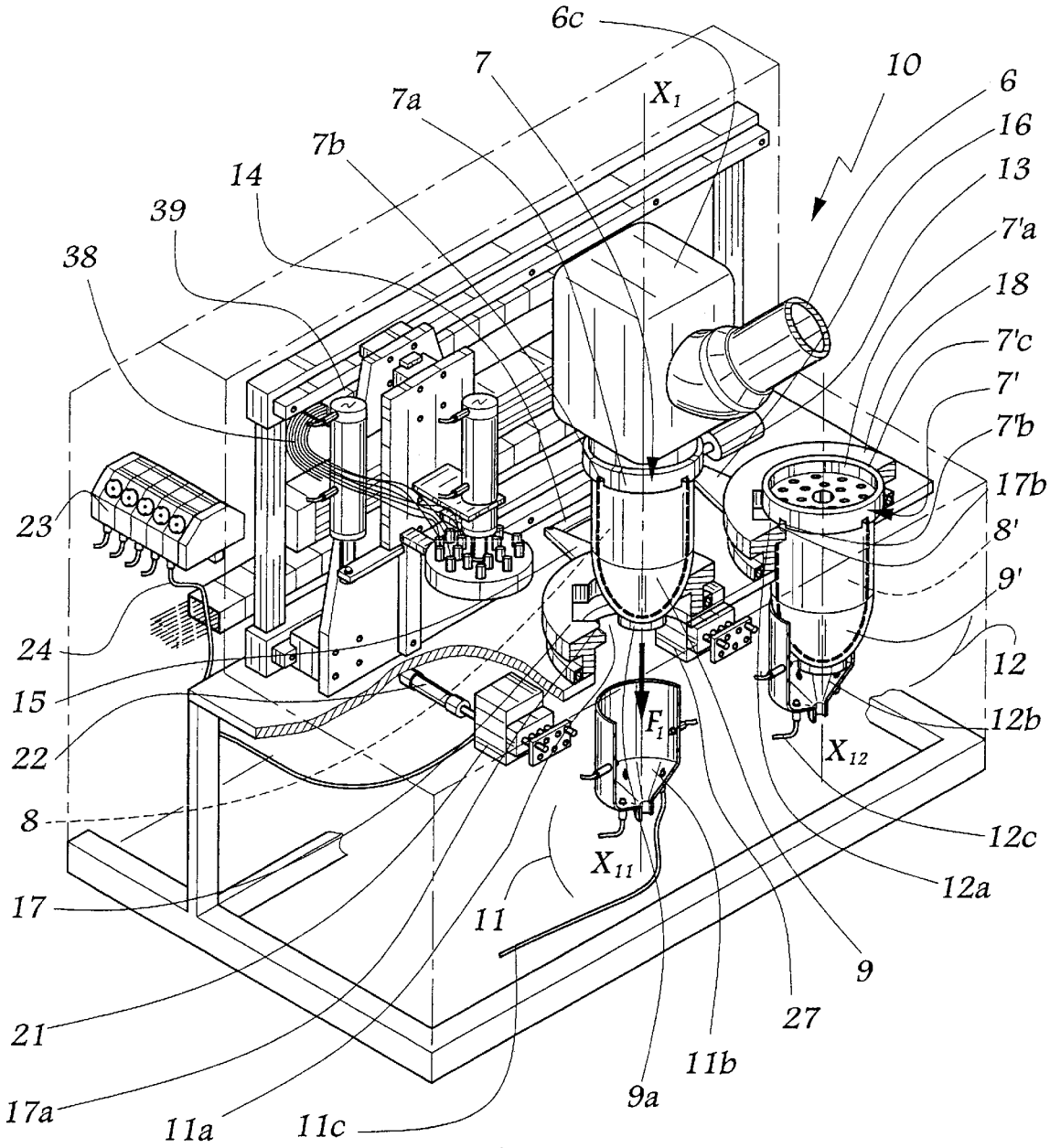
FIG. 2 is a view in perspective with parts torn away of the product changing station of the installation of FIG. 1 during a first step of the process of the invention.

As is more clearly visible in FIG. 2, this station 10 is provided with two areas 11 and 12 for receiving sub-assemblies of the type such as sub-assembly 7. More precisely, the area 11 is empty and ready to receive sub-assembly 7, while area 12 contains a similar sub-assembly 7' which comprises a reservoir 8' and a spray 9' similar to those of sub-assembly 7. Sub-assemblies 7 and 7' may be alternately mounted on the segment 6*c* of the arm 6, as will appear from the following explanations.

In the step of the process shown in FIG. 2, the arm 6 is in a phase of approach in which it brings the sub-assembly 7 above the area 11 of the station 10. From the position shown in FIG. 2, the arm 6 imparts to the sub-assembly 7 a descending vertical movement represented by arrow $F_1$, which makes it possible to bring the sub-assembly 7 into the area 11 as shown in FIG. 3.

A jack 13 controls a rod 14 fast with two connecting rods 15 and 16 themselves fast with rings 17 and 18 disposed respectively around the openings 11*a* and 12*a* of areas 11 and 12. In fact, areas 11 and 12 are formed by receptacles 11*b* and 12*b*, whose inner shape is adapted to the outer shape of the sub-assemblies 7 and 7', and which are connected by evacuation conduits 11*c* and 12*c* to a bleed (not shown).

Sub-assembly 7 is mounted on segment 6*c* of the arm 6 thanks to a ring 7*a* capable of a movement of rotation about axis $X_1$ of sub-assembly 7.

Figure 3:
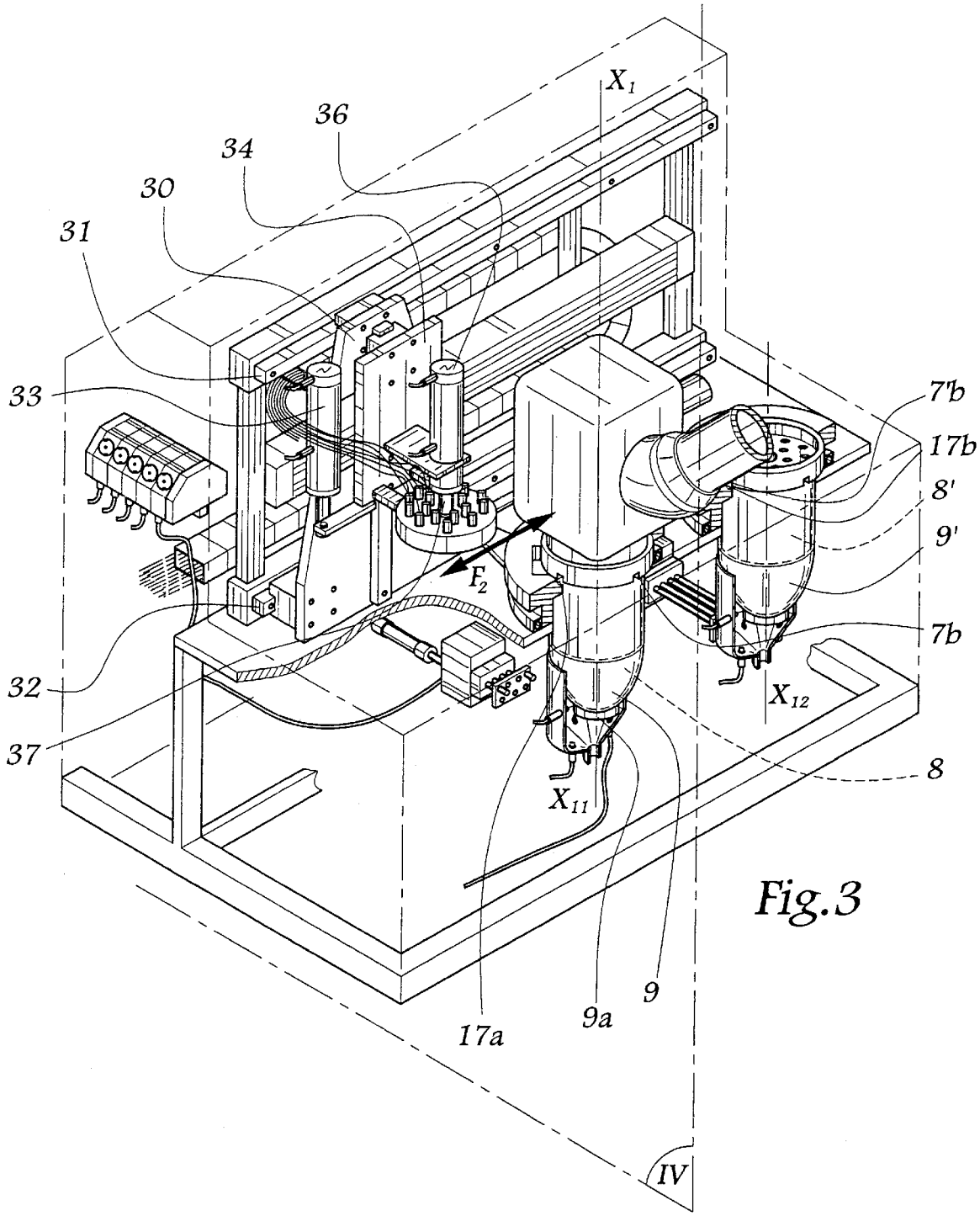
FIG. 3 is a view similar to FIG. 2 during a second step of the process of the invention.

When sub-assembly 7 is in place in area 11, the jack 13 is activated so that the rod 14 is displaced axially as represented by arrow $F_2$ in FIG. 3, which has the effect of driving the connecting rods 15 and 16 and of rotating the rings 17 and 18 about axes $X_{11}$ and $X_{12}$ of areas 11 and 12. Rings 17 and 18 are provided, on their respective inner faces, with projections 17*a* and 18*a*. These projections are adapted to cooperate with corresponding projections 7*b* and 7'*b* provided on rings 7*a* and 7'*a* of sub-assemblies 7 and 7'. In this way, by manoeuvring the jack 13, the ring 7*a* of sub-assembly 7 present in area 11 is made to rotate about axis $X_1$ and this is provided to allow disconnection of the sub-assembly 7 from the arm 6 of robot 1.

Figure 6:
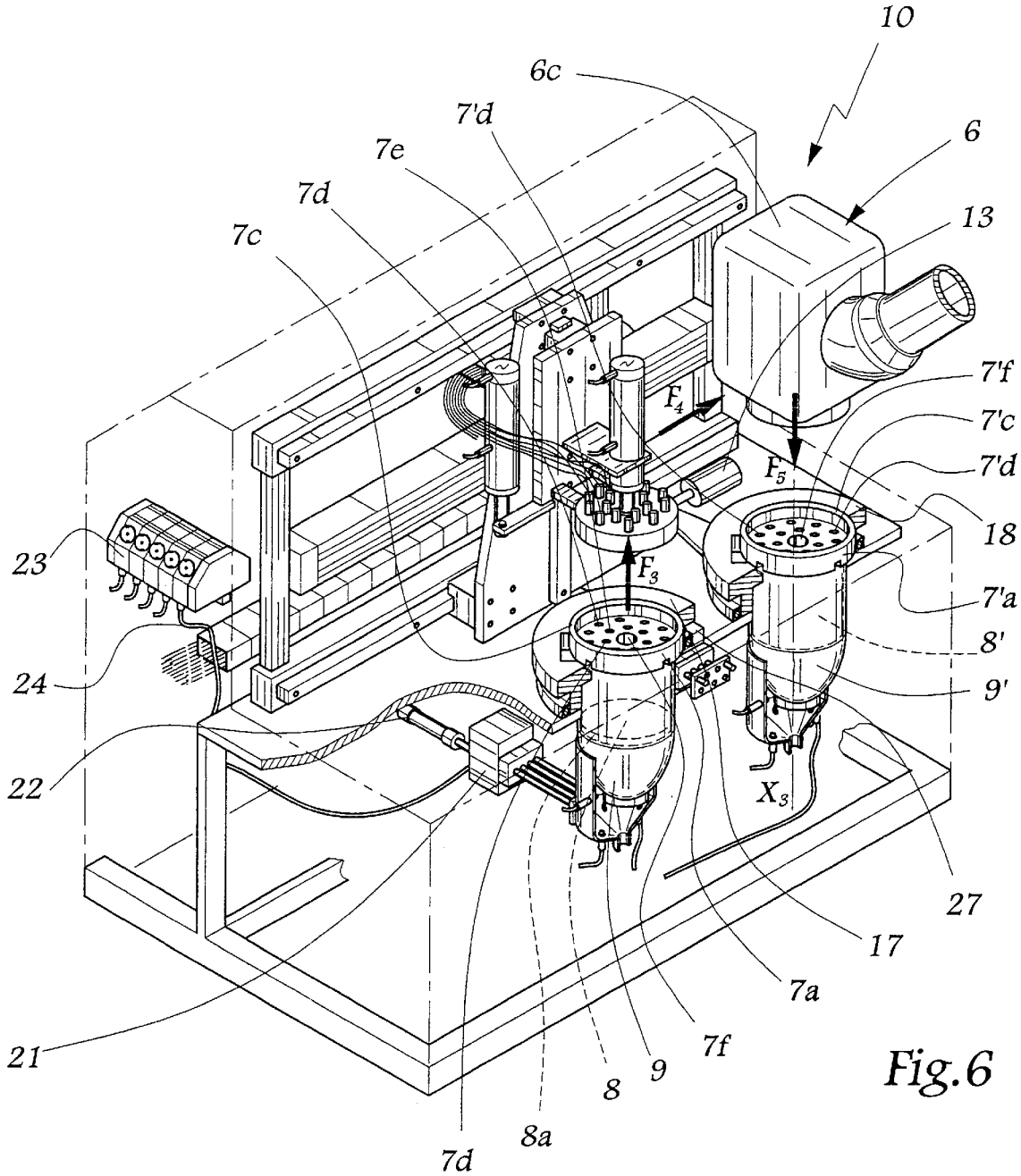
FIG. 6 is a view similar to FIG. 2 during a fourth step of the process of the invention.

We are then in the position of FIG. 6 where the segment 6*c* of the arm 6 is raised as represented by arrow $F_3$, then displaced in the direction of area 12 as represented by arrow $F_4$, then lowered towards sub-assembly 7', as represented by arrow $F_5$. It is then possible to manoeuvre the jack 13 again in order to impart to the ring 18 a movement of rotation about axis $X_3$ as represented by arrow $F_6$ in FIG. 7, with the result that the ring 7'*a* allows the sub-assembly 7' to be locked on segment 6*c* of the arm 6, sub-assembly 7' then being able to be used by the robot 1 to coat a new body after having left station 10, as represented by arrow $F_7$ in FIG. 8.

The upper faces 7*c* and 7'*c* of the sub-assemblies 7 and 7' in fact constitute plans of join allowing assembly of these sub-assemblies alternately on the arm 6 of the robot 1. In particular, orifices 7*d* and 7'*d* for passage of fluid are provided, as well as electrical connectors 7*e* and 7'*e* and, in the central part, an orifice 7*f* or 7'*f* for passage of a manoeuvring rod of a piston 8*a* of the reservoir 8.

Figure 4:
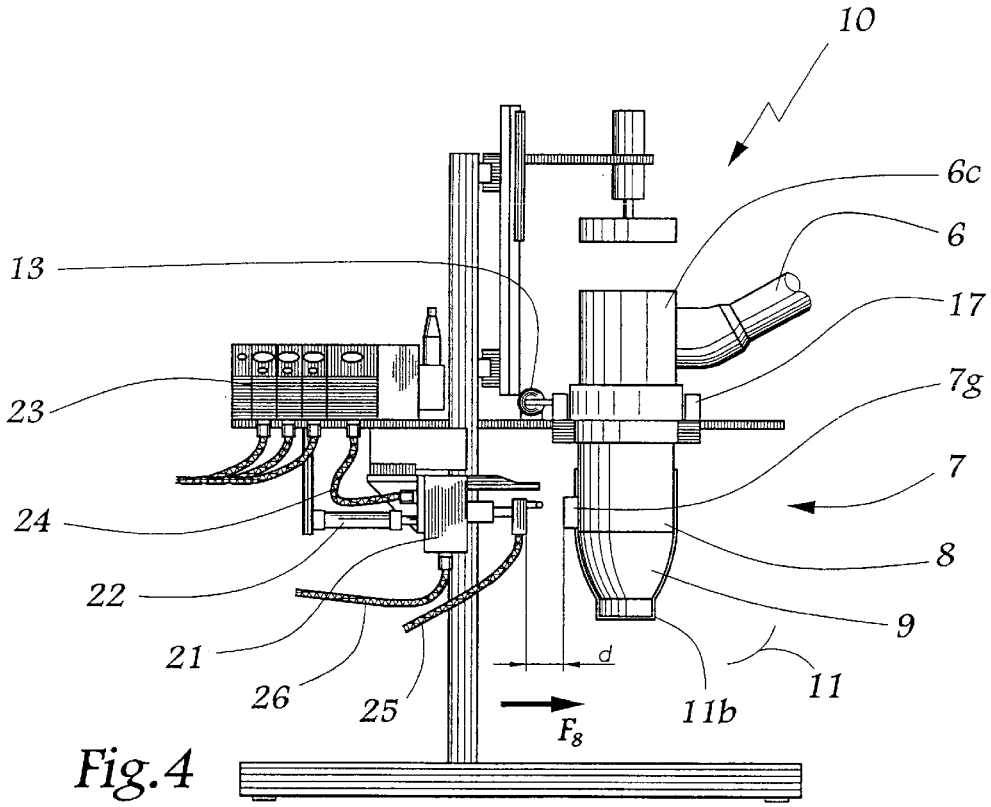
FIG. 4 is a section along plane IV in FIG. 3.
Figure 5:
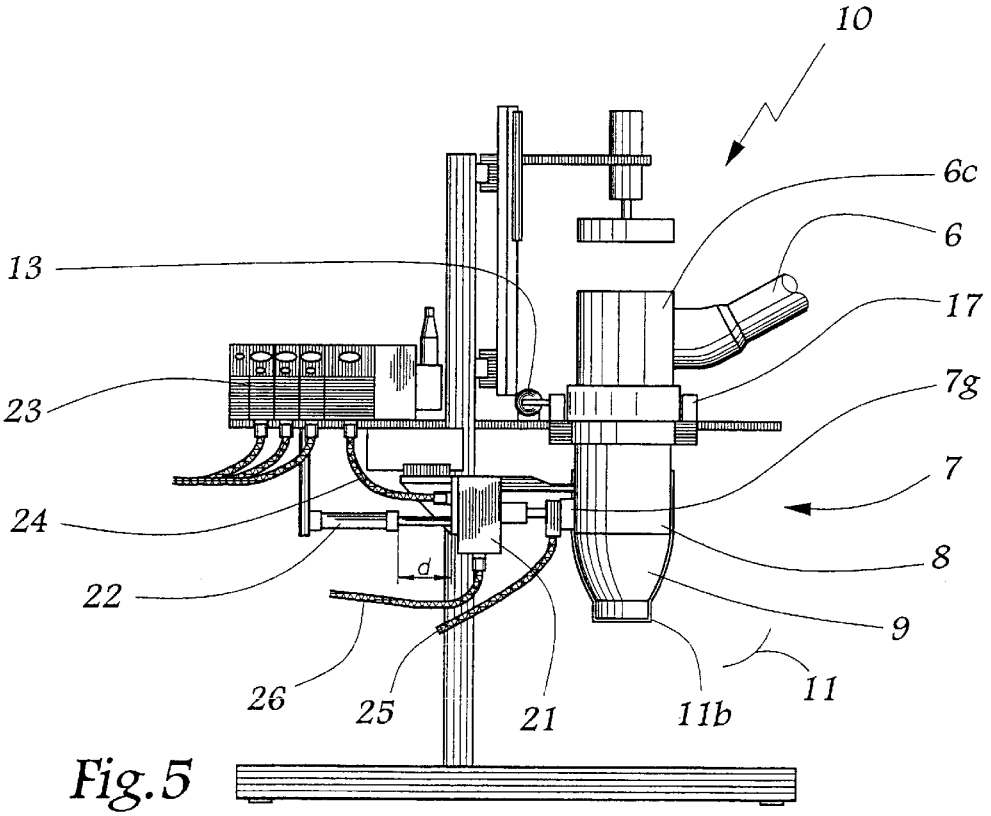
FIG. 5 is a section similar to FIG. 4 during a third step of the process of the invention.

As is visible in FIG. 4, when the sub-assembly 7 is received in the area 11, and before the jack 13 is manoeuvred, a unit 21, radially mobile with respect to axis $X_{11}$, is located at a distance d sufficient in order not to interfere with the movement of introduction of the sub-assembly 7 in the receptacle 11*b*. This unit 21 is then displaced by a jack 22 as represented by arrow $F_8$ in FIG. 4, with the result that it is connected on an area of connection 7*g* of the sub-assembly 7, as shown in FIG. 5.

Unit 21 is connected to a coating product change block 23 via a supple conduit 24. Unit 21 is also connected, via a supple conduit 25, to a source of compressed air (not shown) and, via a conductor 26, to an electronic control unit, likewise not shown. In this way, when it is connected on area 7*g* of the sub-assembly 7, as shown in FIG. 5, the unit 21 allows the reservoir 8 and the spray 9 to be supplied with coating product, current and air. In particular, an air bearing formed in the spray 9 may thus be supplied before the segment 6*c* of the arm 6 is disconnected from the sub-assembly 7, with the result that this air bearing is permanently sufficiently "rigid" to maintain the moving parts in spaced apart relationship and thus to avoid an interference therebetween.

A second unit 27, similar to unit 21, is provided opposite area 12.

Furthermore, the structure of the station 10 comprises a carriage 30 mobile in a direction parallel to a plane containing axes $X_{11}$ and $X_{12}$. The carriage 30 is supported by substantially horizontal rails 31 and 32 and bears a jack 33 adapted to displace vertically, i.e. perpendicularly to the direction of displacement of the carriage 30, a plate 34 which itself supports a connection assembly 35 comprising orifices 35*d* and connectors 35*e* provided to cooperate with the orifices 7*d*, 7*d*' and the connectors 7*e* and 7*e*' of sub-assemblies 7 and 7'. In effect, elements 35*d* and 35*e* are disposed in the same configuration as the corresponding elements in the segment 6*c* of the arm 6. The plate 35 also bears a jack 36 for actuating a rod 37 adapted to penetrate in orifices 7*f* or 7'*f* of one of sub-assemblies 7 and 7'.

Figure 9:
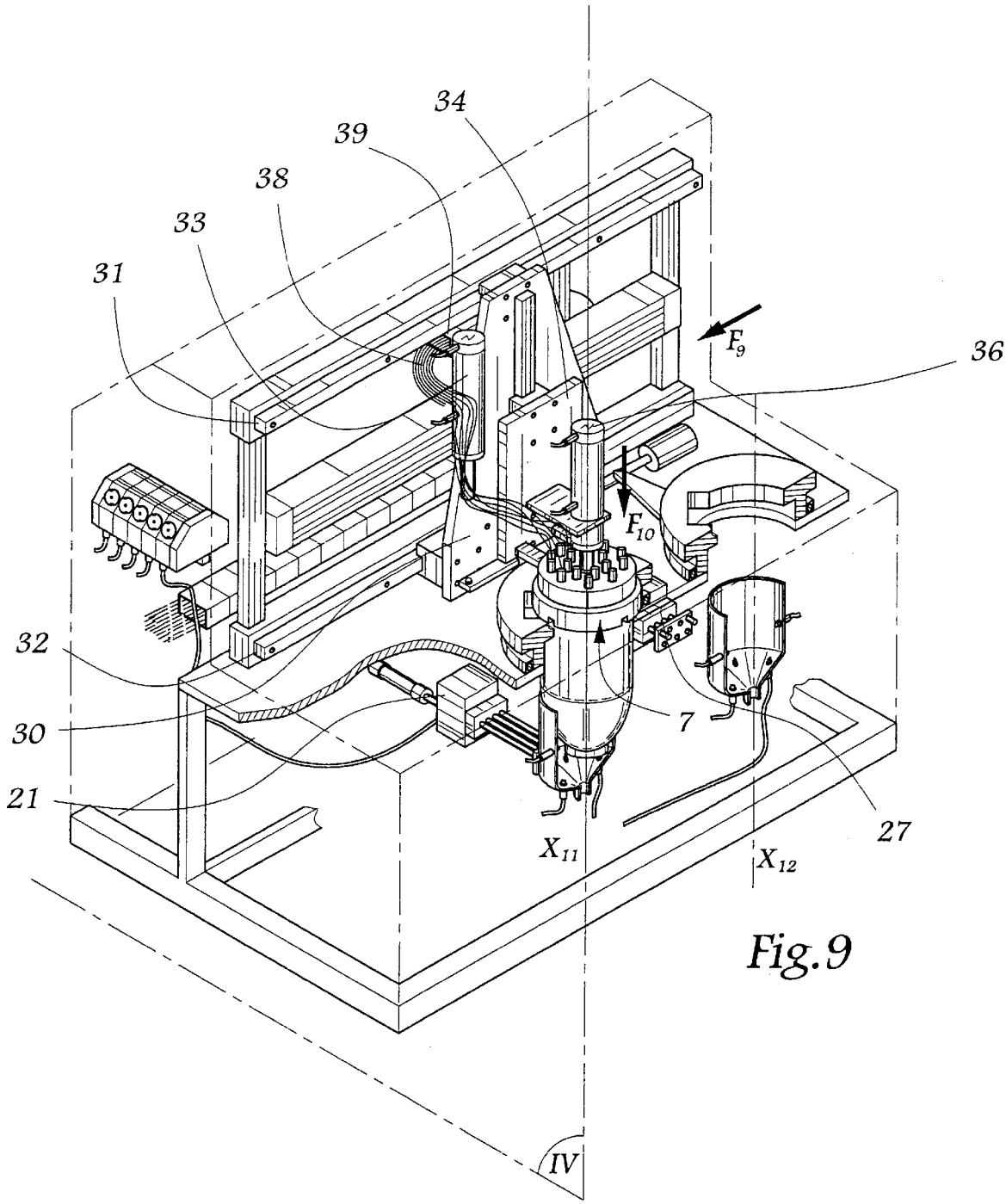
FIG. 9 is a view similar to FIG. 2 during a seventh step of the process of the invention.
Figure 10:
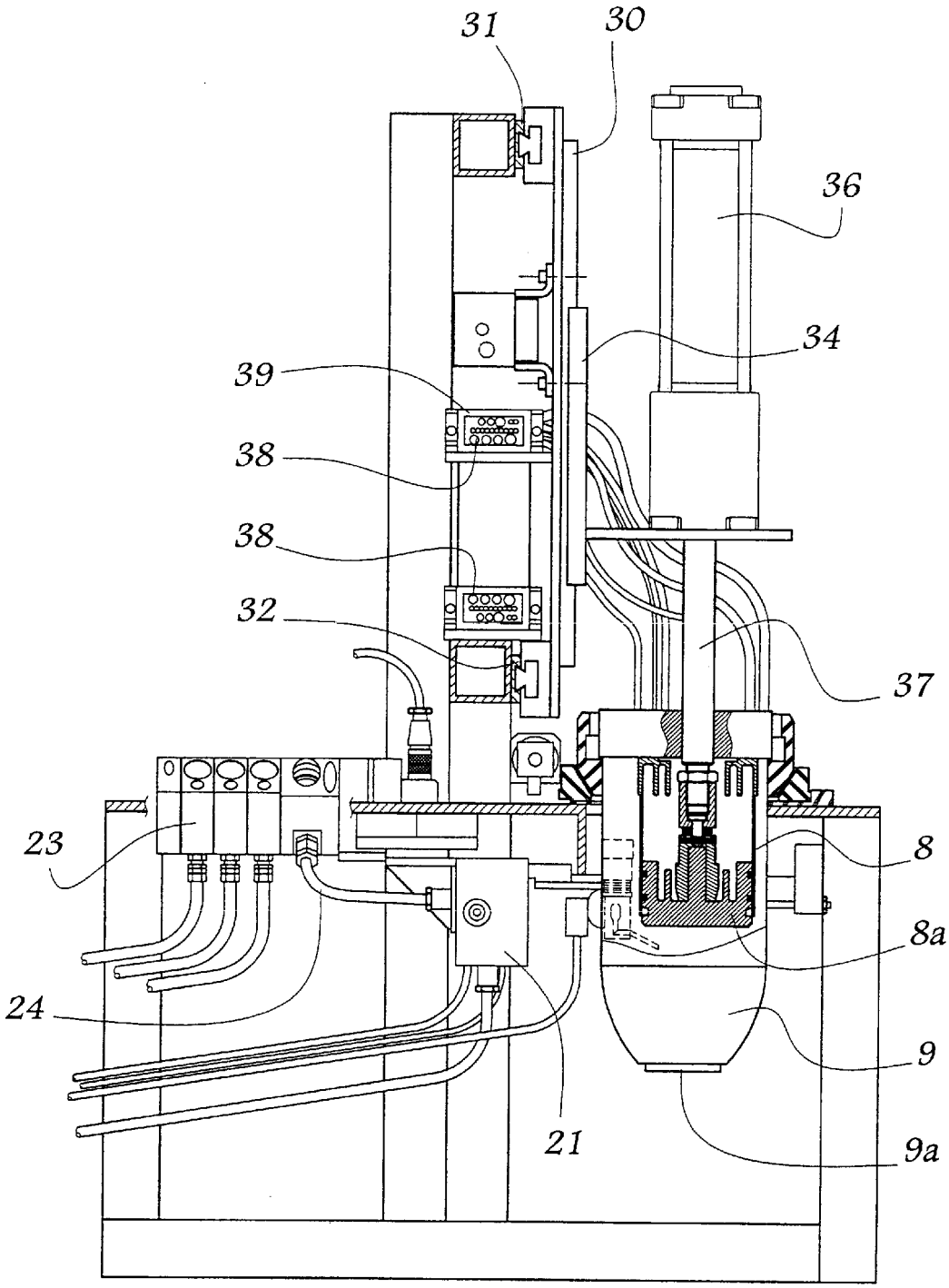
FIG. 10 is a section along plane X in FIG. 9.

In this way, when the carriage 30 has been displaced towards area 11 as represented by arrow $F_9$ in FIG. 9 and when the plate 34 has been lowered as represented by arrow $F_{10}$ in that Figure, the orifices 35*d* and the connectors 35*e* which are connected, via a bundle 38 of tubes and flexible cables received in an unwinder 39, to supply assemblies (not shown) for controlling the sub-assembly 7 in place of the robot 1. In particular, the rod 37 is adapted to penetrate in the sub-assembly 7 as shown in FIG. 11 so as to push the piston 8*a* of the reservoir 8 in order to bleed the reservoir.

The reservoir 8 and the spray 9 may be cleaned in a pre-established sequence of operations, in particular through unit 21, the operational parameters of the reservoir 8 and of the spray 9 being monitored through the connection assembly 35, in the same way as when the sub-assembly 7 is mounted on the robot 1. For example, the speed of rotation of a turbine of the spray 9 may be monitored by means of a speedometer.

Figure 11:
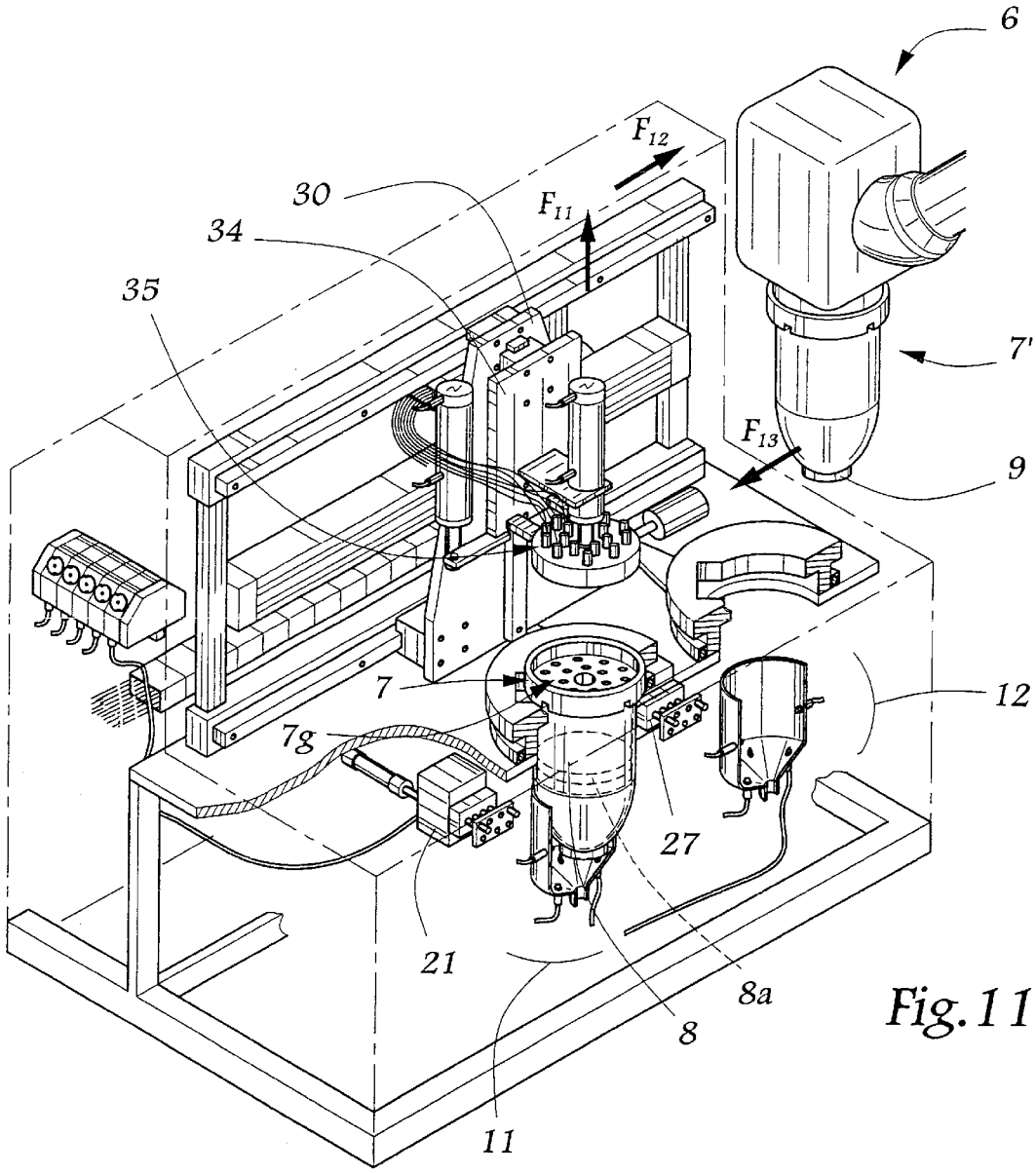
FIG. 11 is a view similar to FIG. 2 during an eighth step of the process of the invention.

The reservoir 8 is filled by the unit 21 as the latter is located nearest to the lower part of the reservoir 8 in the position of FIG. 11, which means that the inner conduits of the connection area 7*g* are short. The unit 21 also cleans the spray 9 by circulating a rinsing product therein, then primes it with a new coating product, by circulating therein a small quantity of new coating product which is then poured into the bottom of the receptacle 11*b* and evacuated via conduit 11*c*.

When these operations are terminated, and as shown in FIG. 11, the connection assembly 35 is disconnected from the sub-assembly 7, the plate 34 is raised as represented by arrow $F_{11}$ and the carriage 30 is returned towards a median position between areas 11 and 12 as represented by arrow $F_{12}$, while the arm 6 of the robot 1 returns the sub-assembly 7' towards the receiving area 12 as represented by arrow $F_{13}$.

Taking the foregoing into account, the time available for cleaning and filling the reservoir 8 and the spray 9 included in the sub-assembly 7 is shorter than or equal to the time of use of the sub-assembly 7', or about 1 min in the case of an installation for spraying coating products on advancing vehicle bodies.

Figure 7:
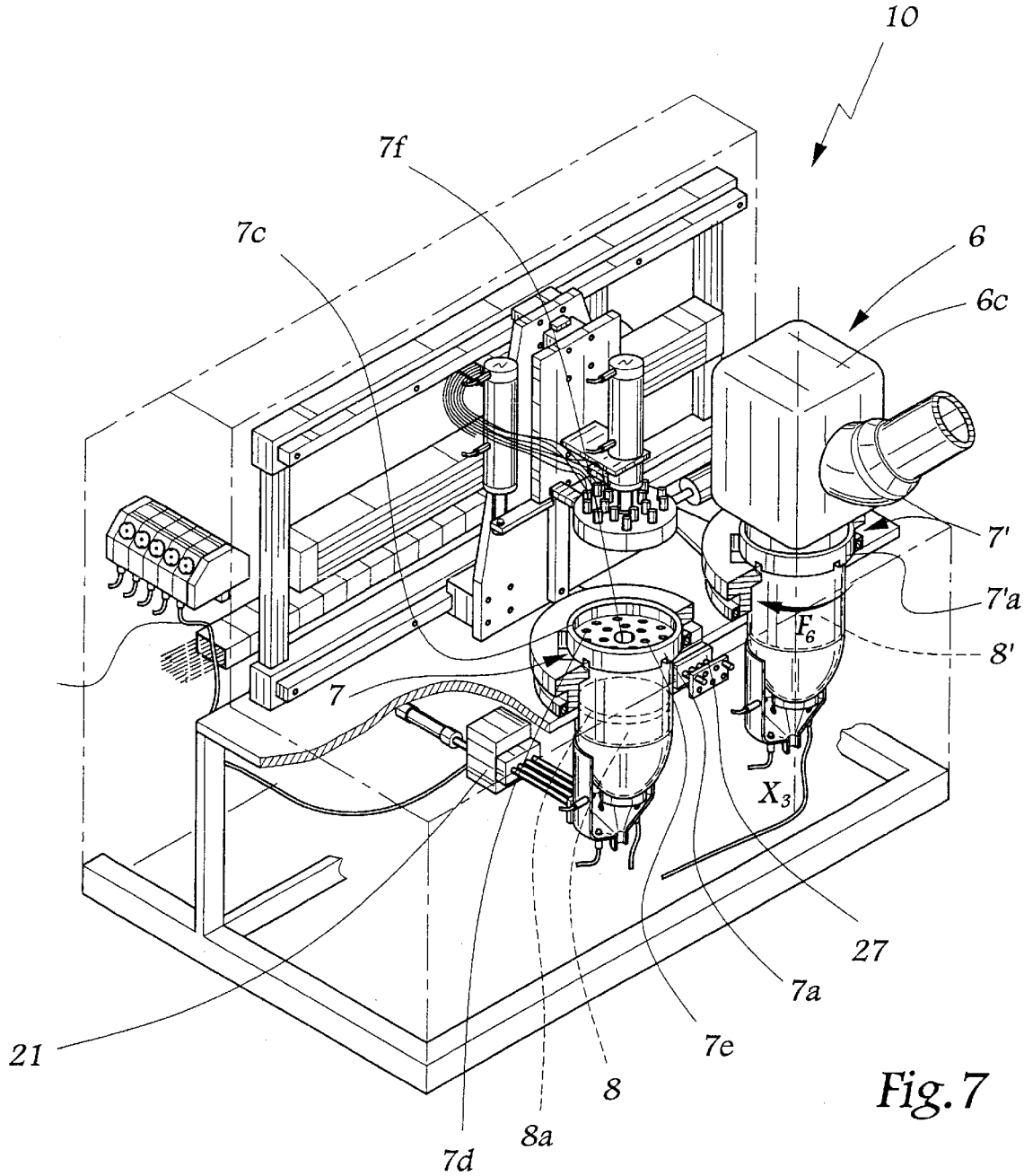
FIG. 7 is a view similar to FIG. 2 during a fifth step of the process of the invention.
Figure 8:
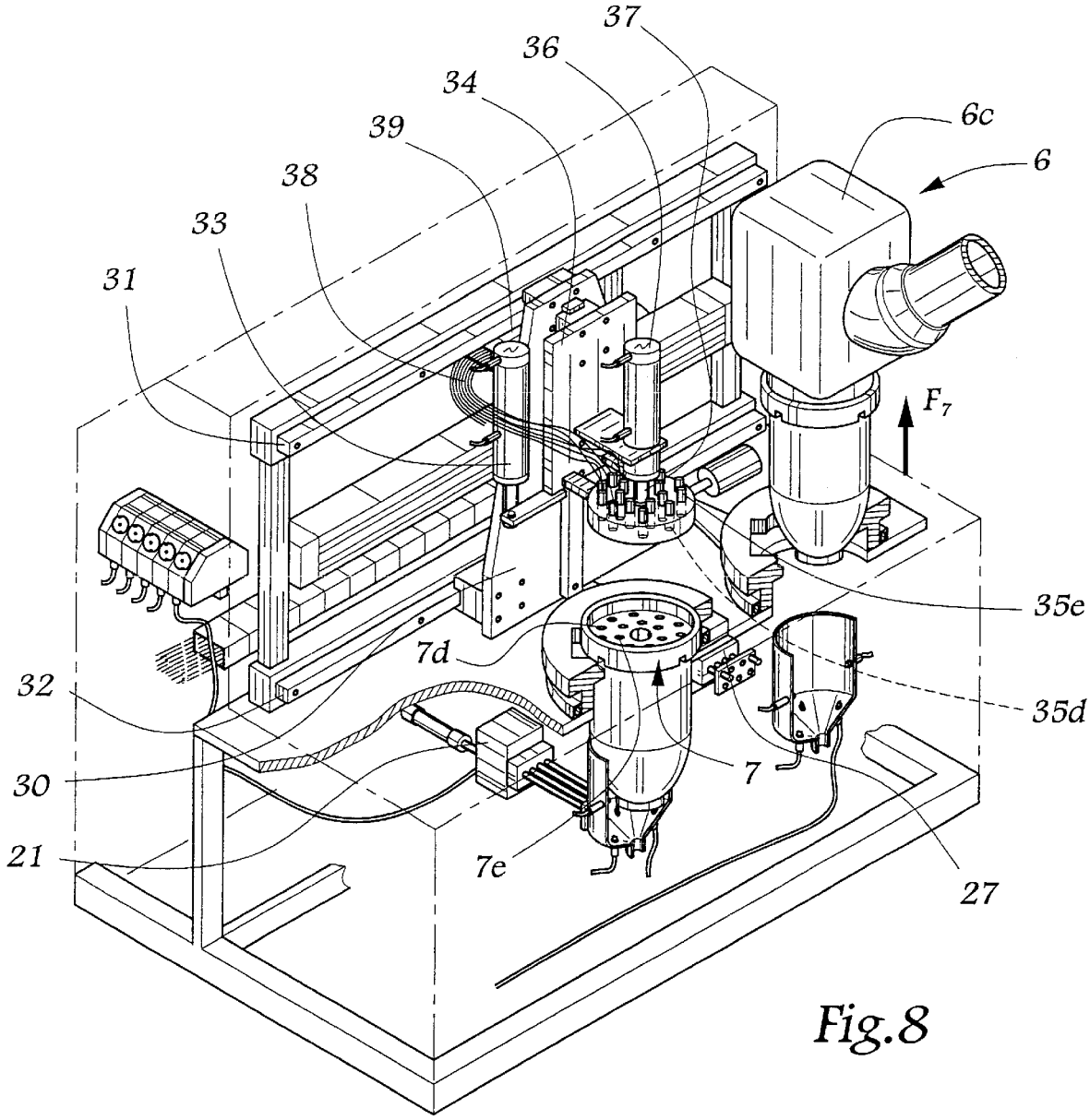
FIG. 8 is a view similar to FIG. 2 during a sixth step of the process of the invention.

This time is largely greater than the time usually available, with the result that these operations of cleaning, of filling the reservoir and of priming the spray may be effected with greater care, while the change of sub-assembly as shown in FIGS. 6 and 7 is particularly rapid, and the production rates can consequently be increased.

What is claimed is:

1. Products changing station (10) in an installation for projecting coating product, said installation comprising at least one robot (1) adapted to displace a spray (9) and a reservoir (8), associated therewith, opposite objects (3) to be coated, said station comprising at least two areas (11, 12) for cleaning/filling said reservoir (8), characterized in that said areas are adapted each to receive a sub-assembly (7,7') formed by a reservoir (8,8') and a spray (9, 9') while this sub-assembly is disconnected from said robot (1), means (21, 27,35) being provided for cleaning and/or filling said reservoir and said spray in each of said areas.

2. Station according to claim 1, characterized in that said means comprise two mobile units (21,27,35) adapted to be connected independently in two areas of connection to said sub-assembly (7), a first unit (21,27) being adapted to be connected to said sub-assembly mounted on said robot (1), while a second unit (35) is adapted to be connected to said sub-assembly in place of the connection part (6*c*) of said robot.

3. Station according to claim 2, characterized in that said first unit (21,27) comprises means for connection between a source of compressed air and a bearing formed in said spray (9), between two parts in relative movements.

4. Station according to claim 2, characterized in that said second unit (35) bears a jack (36) whose rod (37) is adapted to maneuver a piston (8*a*) of said reservoir (8), in particular for bleeding said reservoir.

5. Station according to claim 1, characterized in that it comprises means for locking a sub-assembly in each of said areas, by rotation of a ring (17,18) surrounding said sub-assembly (7,7') and adapted to cooperate with projections (7*b*,7'*b*) on said sub-assembly in order to rotate it ($F_6$) with respect to said robot.

6. Station according to claim 5, characterized in that rotation said ring (17,18) between a position of locking and a position of unlocking of said sub-assembly, is controlled by a lack (13).

* * * * *